US006179579B1

(12) United States Patent
Dobler et al.

(10) Patent No.: US 6,179,579 B1
(45) Date of Patent: Jan. 30, 2001

(54) MULTI-STAGE SIDE-CHANNEL FUEL PUMP FOR A MOTOR VEHICLE

(75) Inventors: Klaus Dobler; Michael Huebel, both of Gerlingen; Willi Strohl, Beilstein, all of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/423,022

(22) PCT Filed: Mar. 13, 1999

(86) PCT No.: PCT/DE99/00688

§ 371 Date: Oct. 29, 1999

§ 102(e) Date: Oct. 29, 1999

(87) PCT Pub. No.: WO99/47814

PCT Pub. Date: Sep. 23, 1999

(30) Foreign Application Priority Data

Mar. 18, 1998 (DE) ..... 198 11 893

(51) Int. Cl.[7] ..... F04B 35/04
(52) U.S. Cl. ..... 417/356
(58) Field of Search ..... 417/356, 423.1, 417/355; 415/55.1, 55.2, 55.3, 55.4

(56) References Cited

U.S. PATENT DOCUMENTS 5,472,321 * 12/1995 Radermacher ..... 417/365
5,551,842 * 9/1996 Schmidt et al. ..... 417/203
5,904,468 * 5/1999 Dobler et al. ..... 415/55.2
5,961,276 * 11/1999 Huebel et al. ..... 415/55.1

FOREIGN PATENT DOCUMENTS

95/25885 9/1995 (WO) .

* cited by examiner

*Primary Examiner*—Teresa Walberg
*Assistant Examiner*—Vinod D. Patel
(74) *Attorney, Agent, or Firm*—Michael J. Striker

(57) ABSTRACT

A multi-stage side-channel pump (1) in particular for fuel for a motor vehicle, having at least first blade chambers (16) of a precursor stage (7) and second blade chambers (17) of a main stage (10). The side-channel pump (1) has an electric motor (19) for driving an impeller (13). The electric motor (19) has a rotor (22) and a stator (24). The first blade chambers (16) of the precursor stage (7) and the second blade chambers 17 of the main stage (10) are integrated with the impeller (13). The impeller (13) can also form the rotor (22), making it possible to produce an extremely shallow side-channel pump (1). This pump is employed preferably for fuel delivery in gasoline injection to an internal combustion engine.

16 Claims, 8 Drawing Sheets

MULTI-STAGE SIDE-CHANNEL FUEL PUMP FOR A MOTOR VEHICLE

PRIOR ART

Figure 1:
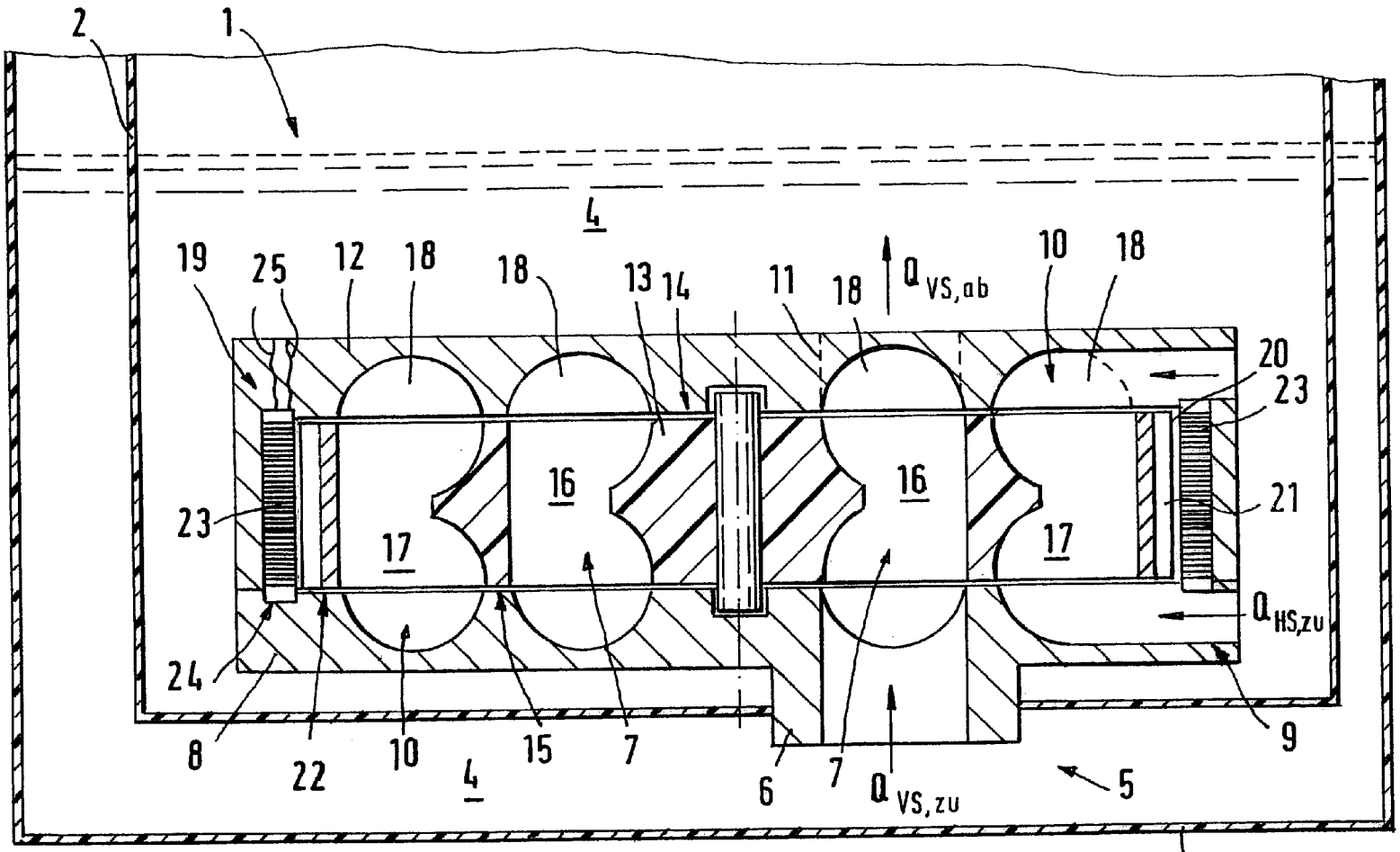

The invention relates to a multi-stage side-channel pump for fuel for a motor vehicle, of the generic type defined by the preamble to claim 1.

From international patent disclosure WO 95/25885, a fuel pump is known which is accommodated as a side-channel pump together with an electric motor in a housing. The electric motor drives the side-channel pump. To that end, the electric motor has an armature winding mounted on the rotor shaft of the fuel pump. This winding runs in a stator comprising permanent magnet segments. The supply of current to the rotor winding is effected via a commutator seated on the rotor shaft and two current brushes resting radially with spring pressure on the commutator. This one-stage fuel pump can be converted into a multi-stage fuel pump, of the kind also known in the prior art, by disposing a further impeller on the rotor axis.

ADVANTAGES OF THE INVENTION

The multi-stage side-channel pump according to the invention for fuel for a motor vehicle having the definitive characteristics of claim 1 has the advantage that a multi-stage nature of this side-channel pump is attained while reducing the number of impellers required. First blade chambers of a precursor stage and second blade chambers of a main stage are integrated into a single impeller. In addition, a brushless DC motor is integrated with the impeller of the side-channel pump. The rotor is simultaneously the impeller. It may be necessary for the outside diameter of the impeller of the side-channel pump to be increased. However, by additional provisions, this makes it possible to improve the efficiency of the side-channel pump. For instance, a preferred radial channel course in the inflow and outflow region of the main stage can be made in streamlined fashion. In this way, it is possible to make the side-channel pump more compact and with less engineering effort. The overall result is a very shallow unit.

By means of the provisions recited in the other claims, advantageous refinements of and improvements to the multistage side-channel pump defined by claim 1 for fuel for a motor vehicle are possible.

An especially advantageous embodiment provides that the side-channel pump is embodied as a two-stage two-sided channel pump. This has characteristics of a kind that can each be advantageously employed in a side-channel pump for fuel for a motor vehicle as defined by claim 1. The side-channel pump has an impeller which has first and second blade chambers. The first blade chambers are those of a precursor stage, and the second blade chambers are those of a main stage. The second blade chambers are surrounded concentrically in the impeller by the first blade chambers. Since the side-channel pump is embodied with two sides, an upper first side and a lower second side of the impeller are each open to a side channel. The impeller in turn is at the same time the rotor of the electric motor. This rotor is brushless. To that end, it has permanent magnet segments on an outer blade ring of the impeller. While the precursor stage, located closer to an axis of rotation of the impeller, is used to fill a pot which is built into a tank of the motor vehicle, the main stage located farther away assures a requisite system pressure to gasoline injection valves of an internal combustion engine. The main stage has an intake tract, which extends radially into the main stage. Via this intake tract, fuel is aspirated from the built-in pot in the tank. After the pressure buildup in the main stage, the fuel is carried radially outward out of the main stage via a transition channel, and the transition channel discharges into a manifold pipe. This manifold pipe carries the fuel onto the engine. The manifold pipe is preferably integrated with a pot rim of the side-channel pump for fuel for a motor vehicle. In this way, production can be simplified considerably, because fewer components are needed.

The side-channel pump also has a check valve and a fuel line between the precursor stage of the built-in tank pot. This prevents the built-in pot in the tank, previously filled with fuel by the precursor stage, from emptying again when the side-channel pump is not running.

DRAWINGS

Figure 2:
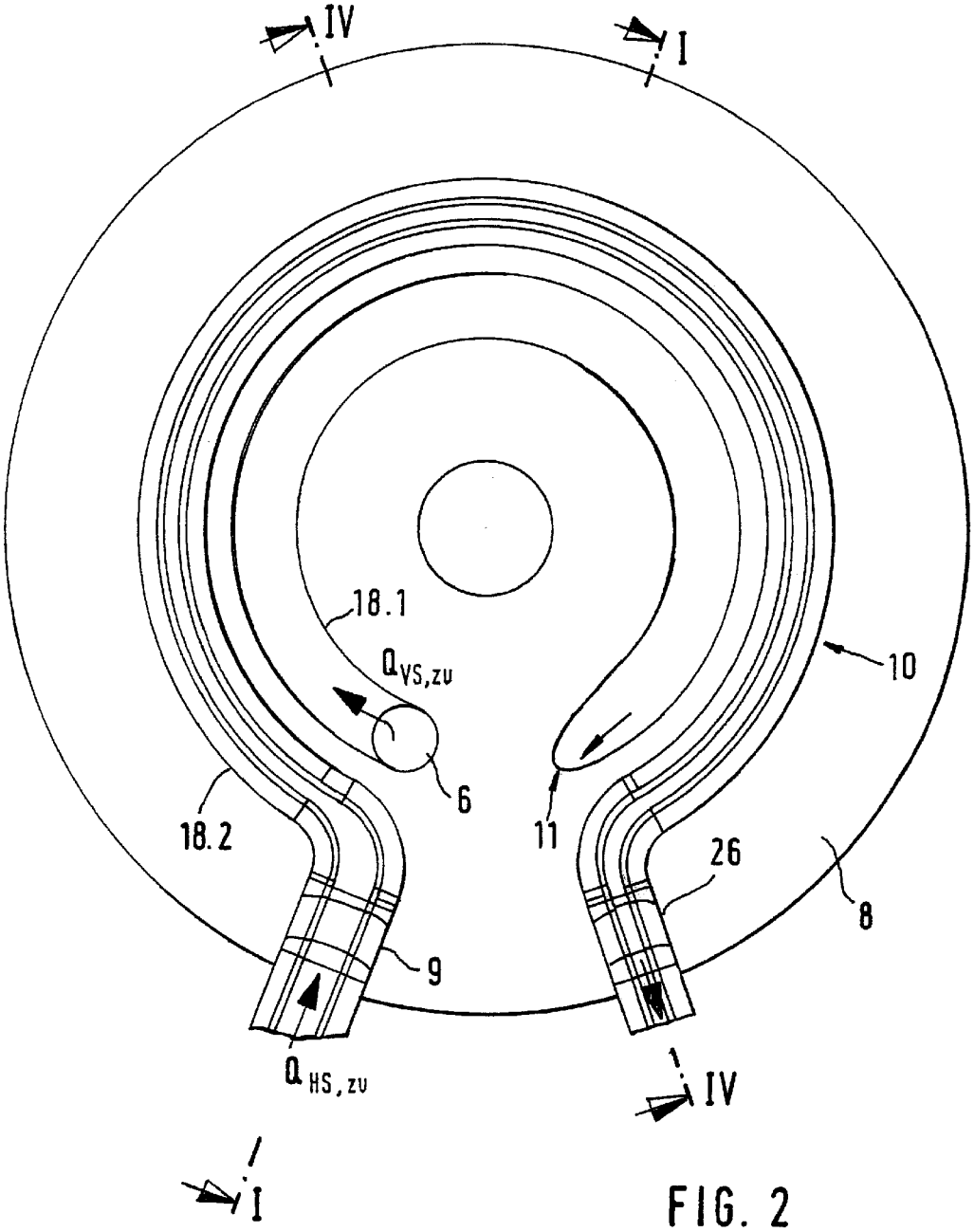
Figure 3:
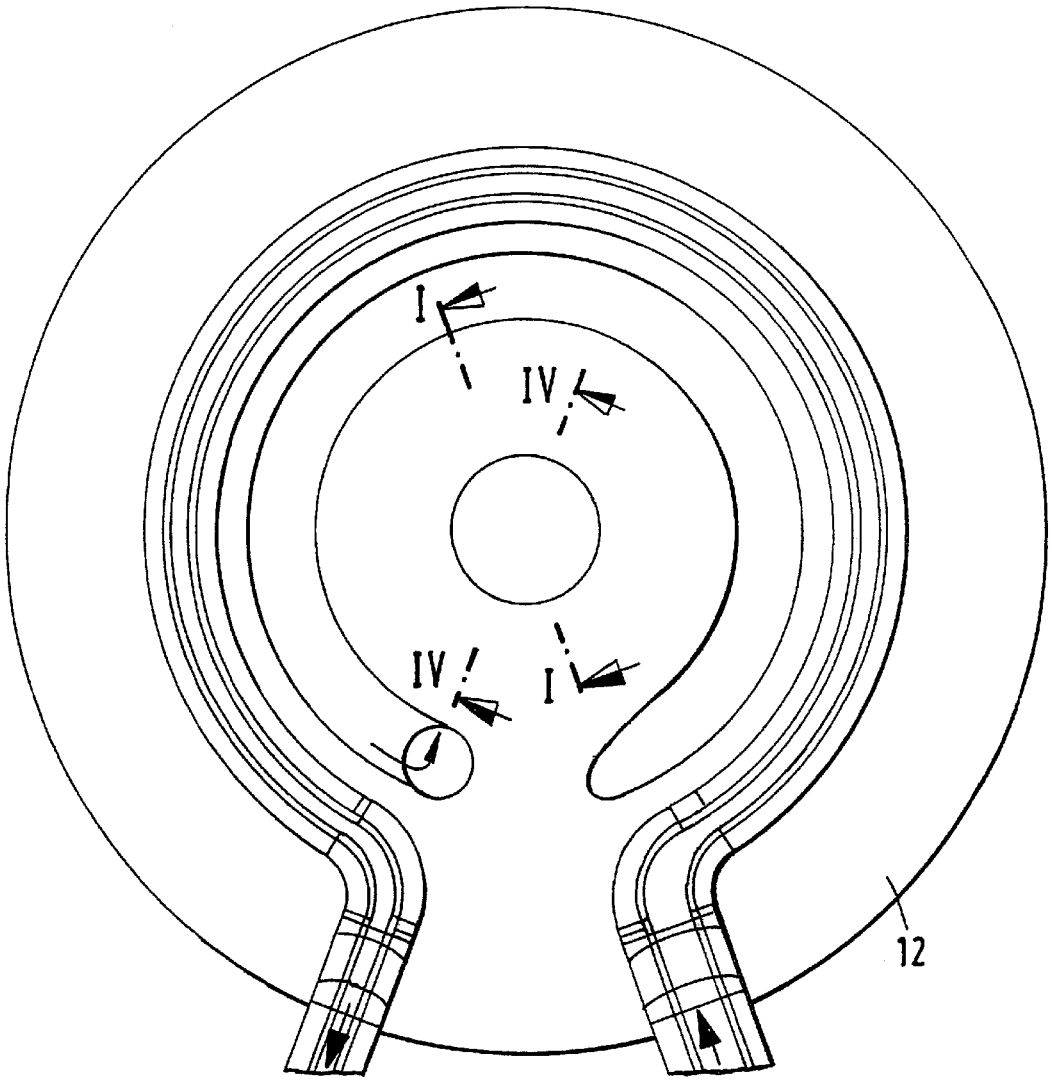
Figure 4:
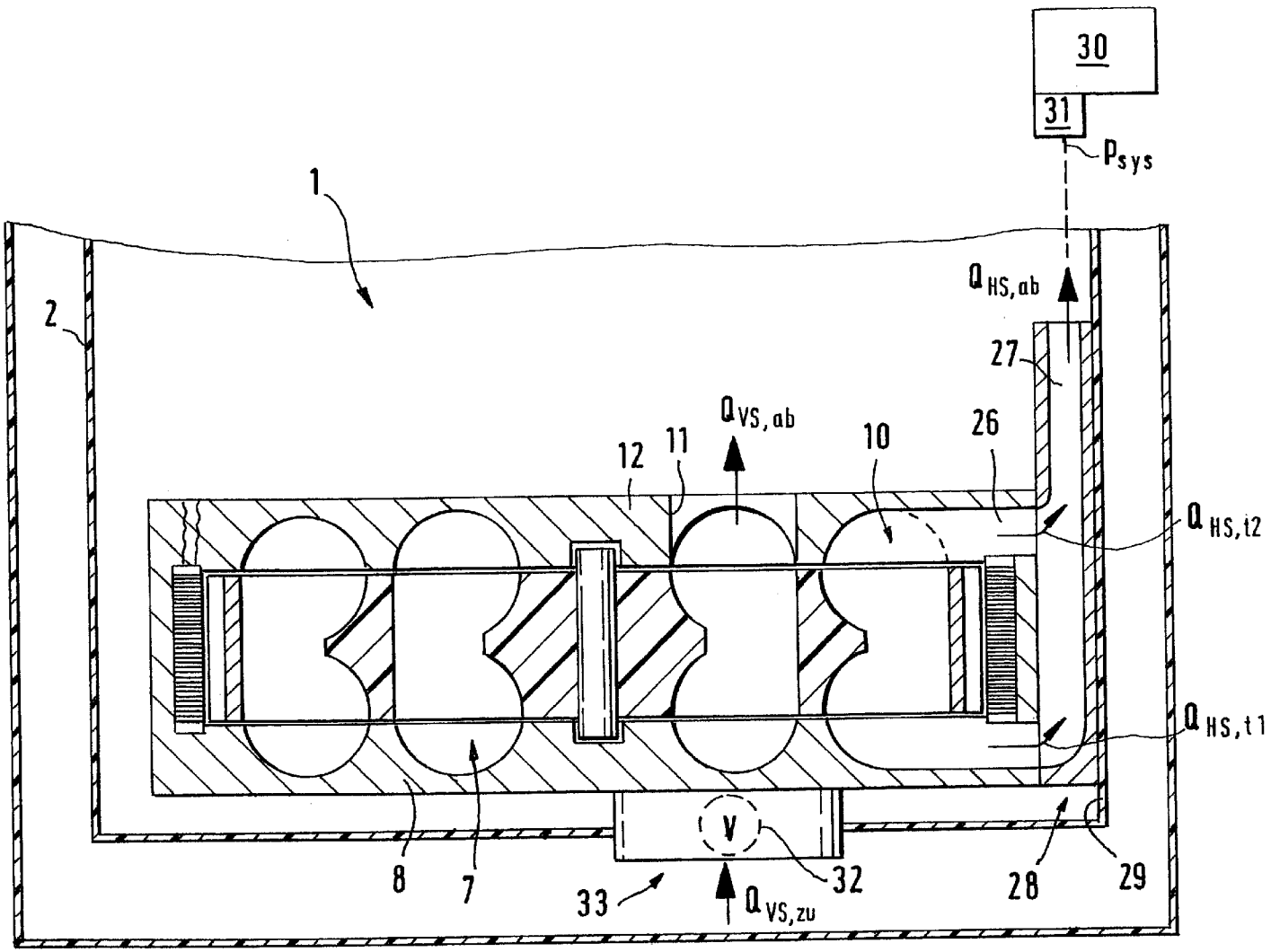
Figure 5:
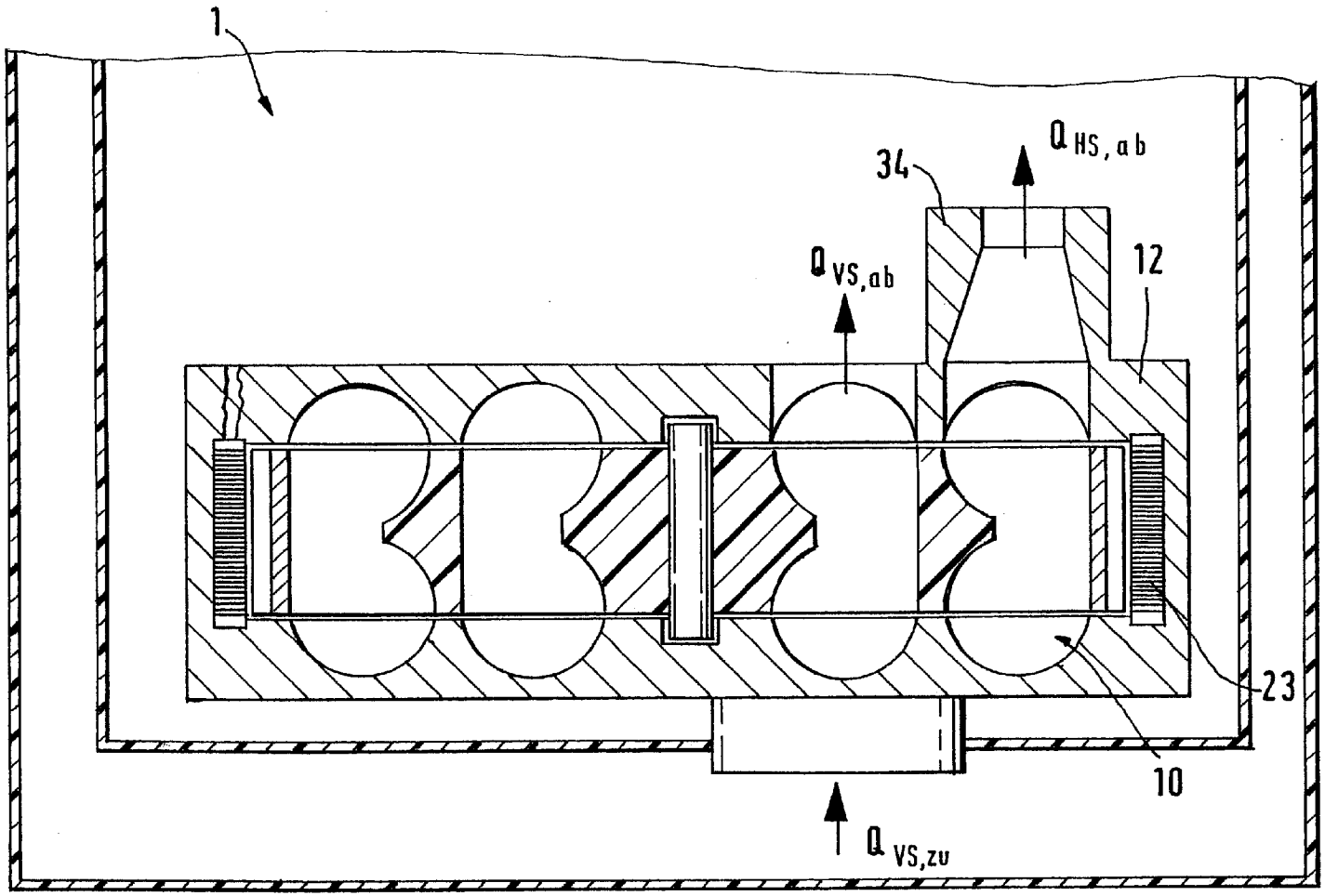
Figure 6:
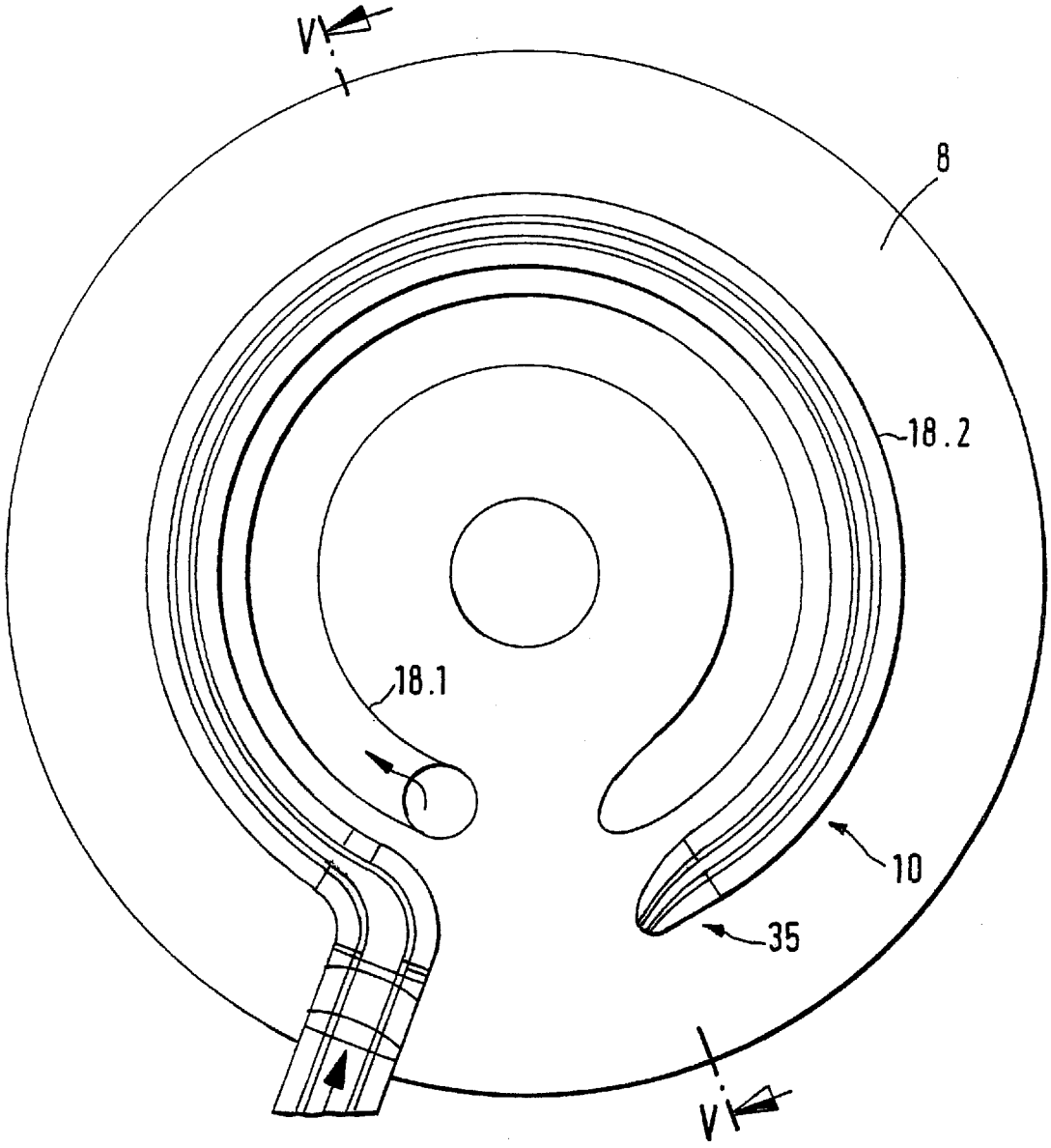
Figure 7:
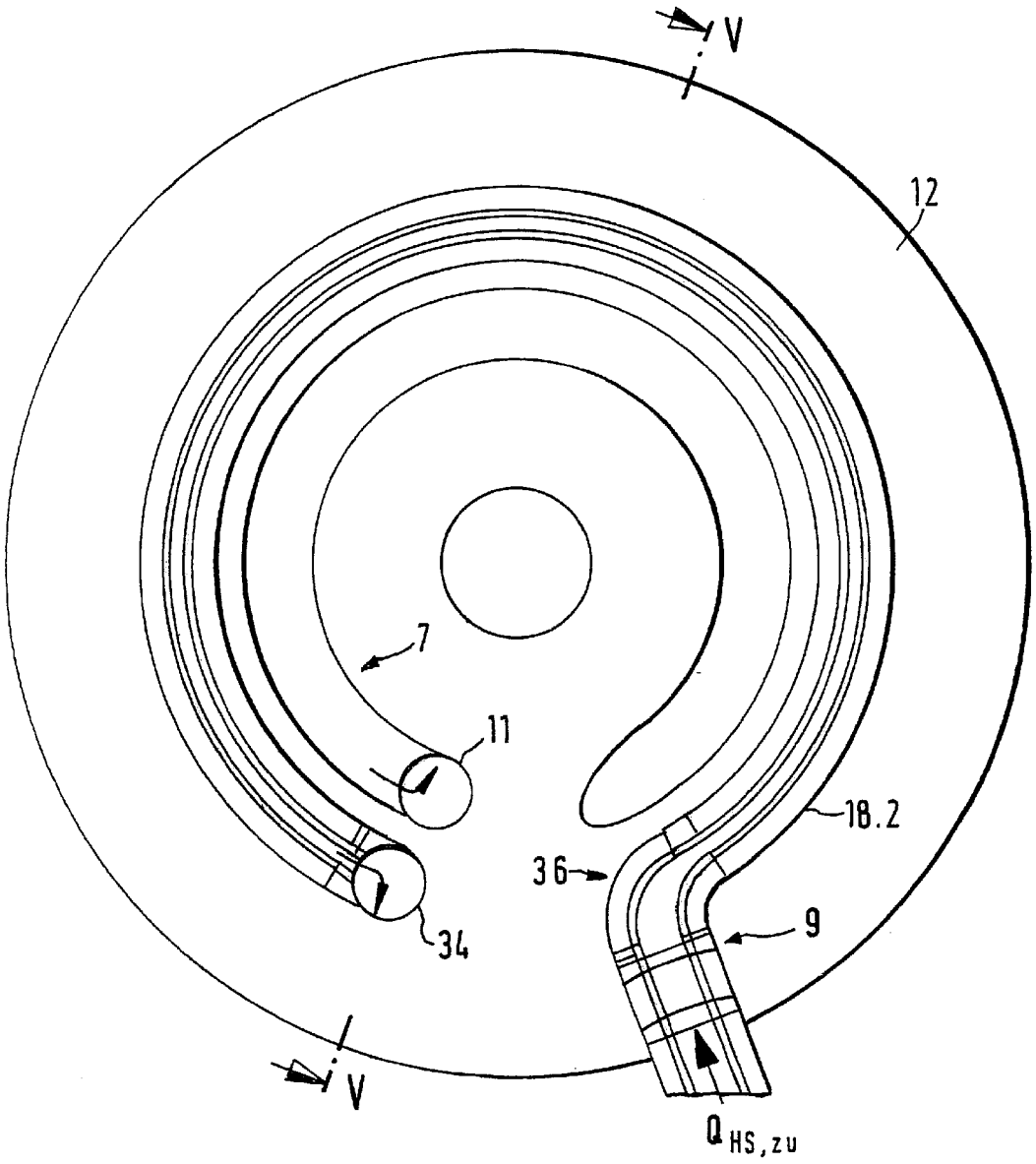

The invention will be described in further detail in the ensuing description in terms of two exemplary embodiments shown in the drawing. Shown schematically are:

FIG. 1, a longitudinal section through a portion of a multi-stage side-channel pump for fuel for a motor vehicle;

FIG. 2, a plan view on an intake cap of FIG. 1;

FIG. 3, a plan view on an outlet cap from FIG. 1;

FIG. 4, a longitudinal section through the side-channel pump for fuel for a motor vehicle of FIG. 1 along a manifold pipe;

FIG. 5, a second embodiment of a multi-stage side-channel pump for fuel for a motor vehicle in longitudinal section, without a manifold pipe but with an axial outflow;

FIG. 6, a plan view on an intake cap of FIG. 5;

FIG. 7, a plan view on an outlet cap of FIG. 5; and

Figure 8:
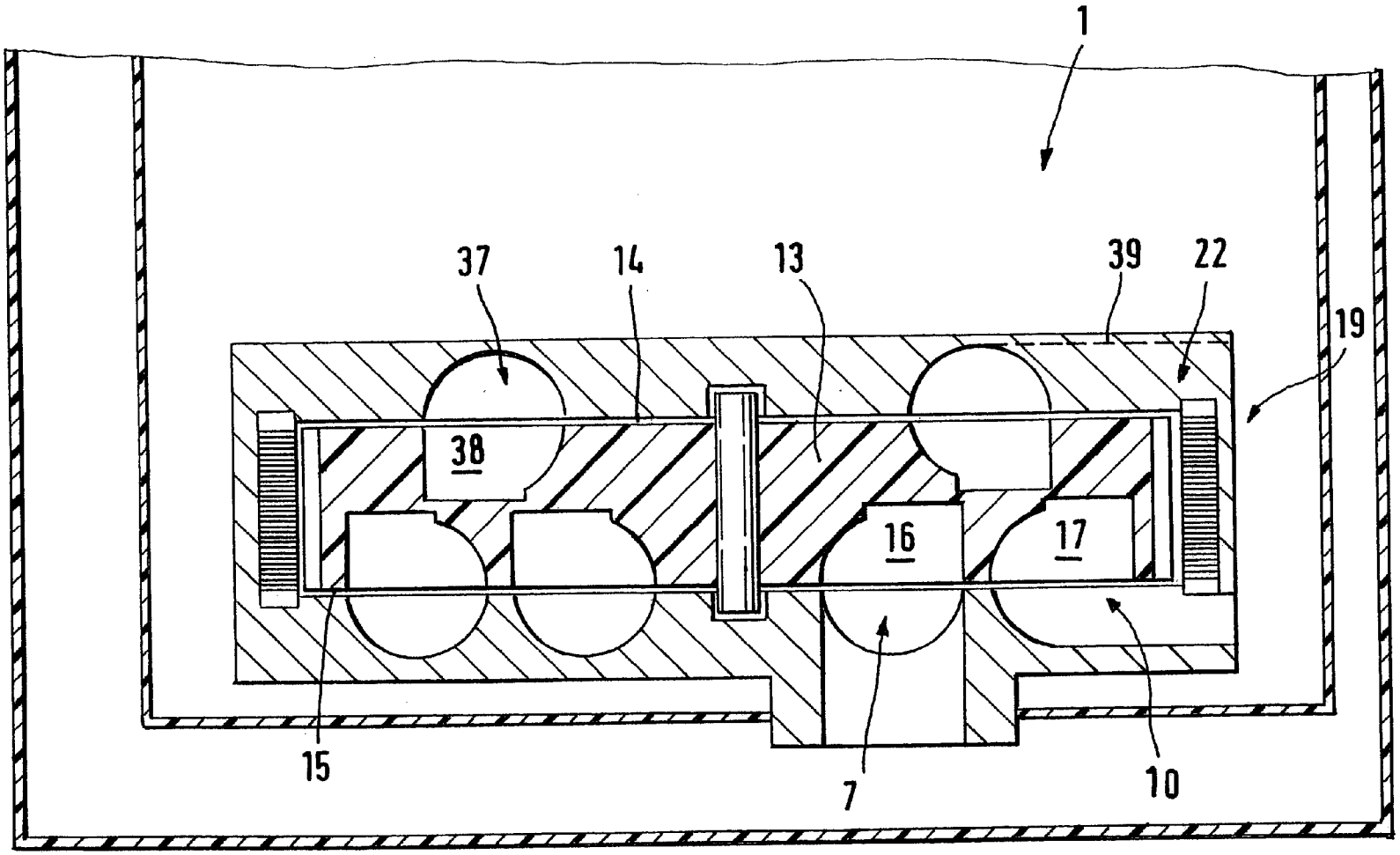

FIG. 8, a longitudinal section through a further multi-stage side-channel pump.

EXEMPLARY EMBODIMENT

FIG. 1 shows a sectional view through a multi-stage side-channel pump 1 for fuel for motor vehicle. This will hereinafter also be called simply side-channel pump 1. It is disposed in a built-in pot 2 which in turn is located in a tank 3 of a motor vehicle. From the tank 3, fuel 4 is delivered at a tank connection 5 via a fuel intake lead 6, on the order of magnitude of a first fuel flow $Q_{VS,\ zu}$, to precursor stage 7 of the side-channel pump 1. The first fuel flow $Q_{VS,\ zu}$ is indicated as an arrow. The fuel intake lead 6 seals the built-in pot 2 in the tank off from the tank 3 at the tank connection 5. As a result, the precursor stage 7 aspirates the fuel 4 directly from the tank 3. The fuel intake lead 6 is also integrated with an intake cap 8 of the side-channel pump 1. The intake cap 8 and the fuel intake lead 6 are a single piece. In this side-channel pump 1, the fuel intake lead 6 is designed such that a predominantly axial inflow of the first fuel flow $Q_{VS,\ zu}$ into the precursor stage 7 is brought about.

The intake cap 8 also has an intake tract 9, by way of which a second fuel flow $Q_{HS,\ zu}$ is carried in a main stage 10 of the side-channel pump 1. The second fuel flow $Q_{HS,\ zu}$ is aspirated from the built-in pot 2 in the tank, which is filled with fuel 4 via the third fuel flow $Q_{VS,\ ab}$ emerging from the precursor stage 7. The precursor stage 7 also has an axially extending fuel outlet 11, which is indicated by dashed lines in an outlet cap 12 of the side-channel pump 1. Via the fuel outlet 11, an axially extending outflow into the built-in pot 2 in the tank is brought about. An impeller 13 with an axis of rotation is disposed between the outlet cap 12 and the intake cap 8. The axis of rotation is indicated by dot-dashed lines. The impeller 13 has a first, upper side 14 and an opposed second, lower side 15.

The side-channel pump 1 shown is a two-sided channel pump, and therefore first blade chambers 16 of the precursor stage 7 and second blade chambers 17 of the main stage 10 are open through the impeller 13 both to the first side 14 and to the second side 15 to the respective side channels 18 in the intake cap 8 and outlet cap 12, respectively. The first blade chambers 16 are located on the inside concentrically about the axis of rotation, since for filling the built-in pot 2 in the tank with fuel 4 a lower pressure is needed then for generating and maintaining a system pressure for a fuel injection to the engine.

An electric motor 19 is also accommodated in the side-channel pump 1. Permanent magnet segments 21 are secured to an outer circumference 20 of the impeller 13. The impeller 13 therefore serves as a rotor 22 of the electric motor 19. In the outlet cap 12, armature winding packets 13 are disposed opposite the permanent magnet segments 21. These packets form the stator 24 of the electric motor 19. The electric motor 19 is exited via suitable electric lines 25. The intake tract 9 for the main stage 10 extends both in the intake cap 8 and in the outlet cap 12 radially around the stator 24 into the main stage 10. This radial inflow makes it possible to avoid flow losses, particularly upon inflow into the second blade chambers 17. The space required for the radially extending intake tract 9 is also only slight, and thus the side-channel pump 1 can be of very shallow construction.

FIG. 2 shows the intake cap 8 of FIG. 1. In this plan view, the sectional planes of FIG. 1 are also shown, along the plane I—I and of FIG. 1 along the plane IV—IV. In the intake cap 8, the first fuel flow $Q_{VS,\ zu}$ enters the inner side channel 18.1 via the axially extending fuel intake lead 6, and then leaves the inner side channel 18.1 again via the axially extending fuel outlet 11. The second fuel flow $Q_{HS,\ zu}$ then enters the main stage 9 via the intake tract 9 into the outer side channel 18.2, and then via a transition channel 26 extends radially outward out of the main stage 10. Because there is a gentle transition between the outer side channel 18.2 and the transition channel 26, flow losses from turbulence are avoided.

FIG. 3 shows the outlet cap 12 of the side-channel pump 1 of FIG. 1. Once again the sectional planes of FIGS. 1 and 4 are shown along the planes I—I, IV—IV. Since the side-channel pump 1 is a two-sided channel pump, the flow channel course in the outlet cap 12 is equivalent to that in the intake cap 8.

FIG. 4 shows a longitudinal section through the side-channel pump 1 along the plane IV—IV of FIGS. 2 and 3. The sectional plane extends through the fuel outlet 11 out of the precursor stage 7 and through the transition channel 26 of the main stage 10. The transition channel 26 discharges into a manifold pipe 27. In the manifold pipe 27, a first partial flow $Q_{HS,\ t1}$ and a second partial flow $Q_{HS,\ t2}$ are united to form a fourth fuel flow $Q_{HS,\ ab}$. The manifold pipe 27 is integrated with a pot rim 28. This pot rim 28 is a component of the side-channel pump 1. It rests on an inner wall 29 of the built-in pot 2 in the tank. As a result, the manifold pipe 27 braces the side-channel pump 1 in the built-in pot 2 in the tank. However, the manifold pipe 27 can also be a component of the built-in pot 2 in the tank. In that case, the side-channel pump 1 is given lateral bracing via contacting faces between the intake cap 8, outlet cap 12, and manifold pipe 27. If the manifold pipe 27 is a component of the side-channel pump 1, then it is joined as a component, after the impeller 13, outlet cap 12 and intake cap 8 have been joined together, to the side-channel pump 1. Conversely, if the manifold pipe 27 is a component of the built-in pot 2 in the tank, then it can be provided simultaneously with the production of the built-in pot 2 in the tank, for example by plastic injection molding. From the manifold pipe 27, the fourth fuel flow $Q_{HS,\ ab}$ is carried to an only schematically indicated internal combustion engine 30 with gasoline injection 31. A system pressure $P_{sys}$ prevailing at the gasoline injection 31 is built up and maintained by the main stage 10. To prevent the built-in pot 2, filled with fuel 4, in the tank from running empty when the side-channel pump 1 is not running, a check valve 32 which prevents this is located at the precursor stage 7. In this first version shown of a side-channel pump 1, the check valve 32, indicated by dashed lines, is located in a fuel line 33 that belongs to the fuel intake lead 6. The check valve 32 could equally well be mounted on the fuel outlet 11, however. To prevent leaks, of the kind that can occur via gaps between the impeller 13 and the intake cap 8 or outlet cap 12, especially when the impeller 13 is not in motion, suitable sealing provisions are made, such as one or more labyrinth seals, not shown.

In FIGS. 5, 6, 7 and 8 that follow, components identical to those of FIGS. 1 through 4 are identified by the same reference numerals.

FIG. 6 shows a further exemplary embodiment of a side-channel pump for fuel for a motor vehicle. In this side-channel pump 1, there is no radially extending outflow from the main stage 10 into a manifold pipe. Instead, the fourth fuel flow $Q_{HS,\ ab}$ flows in the axial direction out of the main stage 10 into a line connection 34 integrated with the outlet cap 12. This flow course makes it possible for the armature winding packets 23 to assume a greater height compared with the embodiment of FIG. 1. At the same time, because there is no manifold pipe, the side-channel pump 1 is more slender. To prevent flow losses, the line connection 34 has a conical shape, which makes a smooth transition to a pipe segment of constant diameter.

FIG. 6 shows the intake cap that belongs to the side-channel pump 1 of FIG. 5. The sectional plane through the side-channel pump 1 in FIG. 5 is shown along the line V—V. The arrows shown illustrate the flow of fuel in the inner side channel 18.1 and the outer side 18.2. Because of the axial outflow of fuel from the main stage 10, a transition 35 is now present, which carries the fuel to the line connection 34, not shown in this drawing figure.

FIG. 7 shows the outlet cap 12 belonging to the side-channel pump 1 of FIG. 5. Once again, arrows indicate the fuel flow in the outlet cap 12. The sectional plane of the side-channel pump 1 of FIG. 5 is again shown along the line V—V. Via the intake tract 9, the second fuel flow $Q_{HS,\ zu}$ is carried into the outer side channel 18.2 via a constriction 36. From the outer side channel 18.2, the fuel emerges axially into the line connection 34. The axial outflow from the precursor stage 7 proceeds via the fuel outlet 11.

FIG. 8 shows a further exemplary embodiment of a side-channel pump 1. This side-channel pump 1 has three stages. In accordance with an independent concept, a two-stage arrangement, and in particular the arrangement shown in FIG. 8 of three or more stages, can also be embodied by itself, without the impeller 13 being the rotor 19. The first stage is the precursor stage 7; the second stage is the main stage 10. An intermediate stage 37 is located between them. These three stages 7, 10, 37 are all accommodated in the single impeller 13. The precursor stage 7 and the main stage 10 are disposed with the first blade chambers 16 and second blade chambers 17 open toward the second side 15 of the impeller 20 13. Third blade chambers 38 of the intermediate stage 37 are located open toward the first side 14 of the impeller 13. The precursor stage 7 aspirates the fuel 4 from the tank 3 and causes it to flow axially downward into the built-in tank pot 2. The inflow and outflow into and from the intermediate stage 37 are effected via a respective intermediate line 39, of the kind indicated by dashed lines; in this case, the fuel 4 passes directly from the intermediate stage 37 into the main stage 10. The precursor stage 7 fills the built-in tank pot 2, while the intermediate stage 37 and the main stage 10 take over the task of pressure buildup for the gasoline injection, not shown. Compared with the side-channel pumps of FIGS. 1 and 5, the side-channel pump 1 of FIG. 8, because of its dimensions, may under some circumstances have a lower throughput for unit of time, but the side-channel pump shown in FIG. 8 is capable of furnishing a still higher pressure. Despite the three-stage construction of the side-channel pump 1, it is very shallow, because the electric motor 19 is integrated via the impeller 13 as a rotor 22.

What is claimed is:

1. A multi-stage side-channel pump (1), in particular for fuel for a motor vehicle, having at least first blade chambers (16) of a precursor stage (7) and second blade chambers (17) of a main stage (10), wherein the side-channel pump (1) has an electric motor (19) with a rotor (22) and a stator (23) for driving an impeller (13), characterized in that the first blade chambers (16) and second blade chambers (17) are integrated with the impeller (13) of the side-channel pump (1), and that the impeller (13) is the rotor (22) of the electric motor (19).

2. The multi-stage side-channel pump (1) of claim 1, characterized in that the rotor (22) is brushless.

3. The multi-stage side-channel pump (1) of claim 1, characterized in that the first blade chambers (16) and second blade chambers (17) are open on at least a first side (14) of the impeller (13).

4. The multi-stage side-channel pump (1) of claim 1, characterized in that the second blade chambers (17) concentrically surround the first blade chambers (16) or vice versa.

5. The multi-stage side-channel pump (1) of claim 1, characterized in that on the first side (14) and on a second side (15) of the impeller (13), the blade chambers (16, 17) are each open toward a side channel (18), and the second side (15) is opposite the first side (14).

6. The multi-stage side-channel pump (1) of claim 1, characterized in that the first blade chambers (16) and second blade chambers (17) are opened toward the first side (14), while at least third blade chambers (38) extend open toward the second side (15) and form a further stage (37) of the side-channel pump (1), or vice versa.

7. The multi-stage side-channel pump (1) of claim 1, characterized in that an intake tract (9) extends radially into the main stage (10).

8. The multi-stage side-channel pump (1) of claim 1, characterized in that a transition channel (26) extends radially outward from the main stage (10).

9. The multi-stage side-channel pump (1) of claim 8, characterized in that the transition channel (26) discharges into a manifold pipe (27).

10. The multi-stage side-channel pump (1) of claim 9, characterized in that the manifold pipe (27) is integrated with a pot rim (28).

11. The multi-stage side-channel pump (1) of claim 1, characterized in that the precursor stage (7) has an inflow and an outflow, which extend predominantly axially.

12. The multi-stage side-channel pump (1) of claim 1, characterized in that the precursor stage (7) communicates via a line with a built-in pot (2) in the tank and fills this pot.

13. The multi-stage side-channel pump (1) of claim 12, characterized in that a fuel intake lead (6) extends directly to the precursor stage (7) from a tank connection (5), without there being any intake jet pump in the fuel intake lead.

14. The multi-stage side-channel pump (1) of claim 1, characterized in that the main stage (10) generates a pressure buildup for a fuel injection (31).

15. The multi-stage side-channel pump (1) of claim 14, characterized in that the main stage (10) generates the requisite fuel buildup for the fuel injection (31) by itself.

16. The multi-stage side-channel pump (1) of claim 1, characterized in that a check valve (32) is disposed in a fuel line (33) in the precursor stage (7).

* * * * *